United States Patent [19]

Menz et al.

[11] 4,145,972

[45] Mar. 27, 1979

[54] DUAL-MODE WARHEAD INITIATION SYSTEM

[75] Inventors: Fred L. Menz, Columbia; Louis J. Montesi, Silver Spring, both of Md.; Howard S. Leopold, deceased, late of Silver Spring, Md., by Judith S. Leopold, executrix

[73] Assignee: The United States of America as represented by the Secretary of the Navy, Washington, D.C.

[21] Appl. No.: 751,555

[22] Filed: Dec. 17, 1976

[51] Int. Cl.[2] ..... F42B 19/08

[52] U.S. Cl. ..... 102/270; 102/67; 102/DIG. 2

[58] Field of Search ..... 102/56 R, 67, 69, 70.2 R, 102/DIG. 2

[56] References Cited

U.S. PATENT DOCUMENTS

| | | | |
|---|---|---|---|
| 3,853,059 | 12/1974 | Moc | 102/DIG. 2 |
| 3,896,731 | 7/1975 | Kilmer | 102/DIG. 2 |
| 3,980,019 | 9/1976 | Anderson et al. | 102/7.2 |

*Primary Examiner*—Verlin R. Pendegrass

*Attorney, Agent, or Firm*—R. S. Sciascia; A. L. Branning

[57] ABSTRACT

Dual-mode capability is provided in a warhead initiation system having an initiation transfer assembly and two, end booster plates. The initiation transfer assembly comprises five, separate lines of mild detonating cord (MDC) swaged together at one end in an acceptor manifold. Two MDCs of equal length terminate at each of the booster plates and the fifth, shorter MDC is directed to the center of the aft booster plate via an initiation mode selector which controls detonation propagation along this cord.

The safety and arming mechanism of the warhead ignites the acceptor manifold, causing simultaneous initiation of the five MDCs. In the normal mode, a launch signal causes the initiation mode selector to extend a control barrier across the path of the shorter, fifth MDC to prevent faster propagation of detonation to the aft booster plate, thus resulting in dual-ended initiation of the warhead when both end plates are simultaneously ignited by the equal-length MDCs. For single-ended initiation, the mode selector is not actuated, thus permitting the aft booster plate to initiate sooner than the forward plate via the shorter, fifth MDC.

13 Claims, 9 Drawing Figures

DUAL-MODE WARHEAD INITIATION SYSTEM

BACKGROUND OF THE INVENTION

The present invention relates generally to warheads, and more particularly to the control of warhead initiation.

Dual-mode initiation capability is required of a warhead when encountering a broad spectrum of targets which include both air and surface targets. This type of initiation capability is necessary to yield different warhead case fragmentation patterns to provide adequate kill capability against both aircrafts and ships, as representative examples of air and surface targets. For aircraft targets, a warhead is most effective if the pattern of fragmentations is concentrated and close to the target. One means of achieving this concentrated fragmentation pattern is to initiate the warhead from both ends simultaneously.

When directed at surface targets, such as ships, a more widely disbursed fragmentation pattern is more effective, and initiation of the warhead at one end thereof will achieve this pattern. Thus, what is desirable is an initiation system which will permit selection of either single-ended initiation or dual-ended initiation of the warhead depending upon the type of target against which the warhead is directed, with the selection being made during the pre-launch sequence, or at launch by the launch operator.

The majority of existing warhead initiators do not possess the aforesaid dual-mode capability, the with bulk of the initiators igniting the warhead at the center thereof, at both ends simultaneously, or at one end thereof. In the U.S. Pat. No. 3,853,059 to R. G. Moe, the suggestion is made that optimum effectiveness in a configured blast fragmentation warhead may be obtained by a shift of the fragment beam spray which can be achieved by selective initiation of either end of the warhead or simultaneous initiation at both ends, dependent upon target information. Moe states that many currently-existing missiles have available information in the guidance circuitry which is sufficient to provide controls to selectively initiate detonation in an optimum mode based on some combination of missile and target attitude, proximity or other data. The patentee, however, does not disclose the means for controlling this selective warhead intiation.

Safety and arming devices (S & A), which control the arming and initiation of the warhead, can be developed to integrate data from the guidance system and the control inputs from the fire controller to selectively initiate the warhead in the optimum mode. Development of such an S & A, however, will be costly and time-consuming. Consequently, the immediate requirement exists for an inexpensive, effective and reliable multiple mode warhead initiation system.

SUMMARY OF THE INVENTION

Accordingly, it is an object of the present invention to provide a new and improved system to control the initiation of a warhead.

Another object of the invention is to provide a new and improved warhead control system with dual modes of initiating the warhead.

Another object of the invention is to provide a new and improved warhead initiation system having selectable, dual modes.

Still another object of the invention is to provide a new and improved selectable, dual mode warhead initiation system which is effective, efficient and reliable.

These and other objects of the present invention are attained by providing in a warhead initiation system the selective capability of igniting the warhead from one end or from both ends simultaneously to control the fragmentation pattern of the warhead. An initiation transfer assembly is coupled to booster plates at each end of the warhead by five, separate lines of mild detonating cord (MDC). Two cords of equal length terminate at each of the plates and the fifth, shorter cord is directed to the center of one of the plates via an initiation mode selector. All of the detonating cords are simultaneously ignited by the output of the safety and arming mechanism, and for dual-ended initiation; the mode selector is actuated to place a control barrier in the path of the shorter, fifth cord to prevent continued propagation of detonation which would initiate one booster plate earlier than the other. For single-ended initiation, the mode selector is not actuated to permit earlier initiation of one end of the warhead via the shorter, fifth detonating cord.

The concept described herein provide a selective, dual mode, warhead initiation system without the necessity of modifying existing or developing a new safety and arming mechanism. Existing safety and arming devices can be directly utilized, resulting in the obvious advantages of cost and time savings. Fragmentation patterns of the warhead can be tailored for the target to optimize the effectiveness of the warhead, and the warhead can be employed against a larger variety or targets.

BRIEF DESCRIPTION OF THE DRAWINGS

A more complete understanding of the invention and a fuller appreciation of the many attendant advantages thereof will be derived by reference to the following detailed description when considered in connection with the accompanying drawings, wherein.

DETAILED DESCRIPTION OF THE PREFERRED EMBODIMENT

Figure 1:
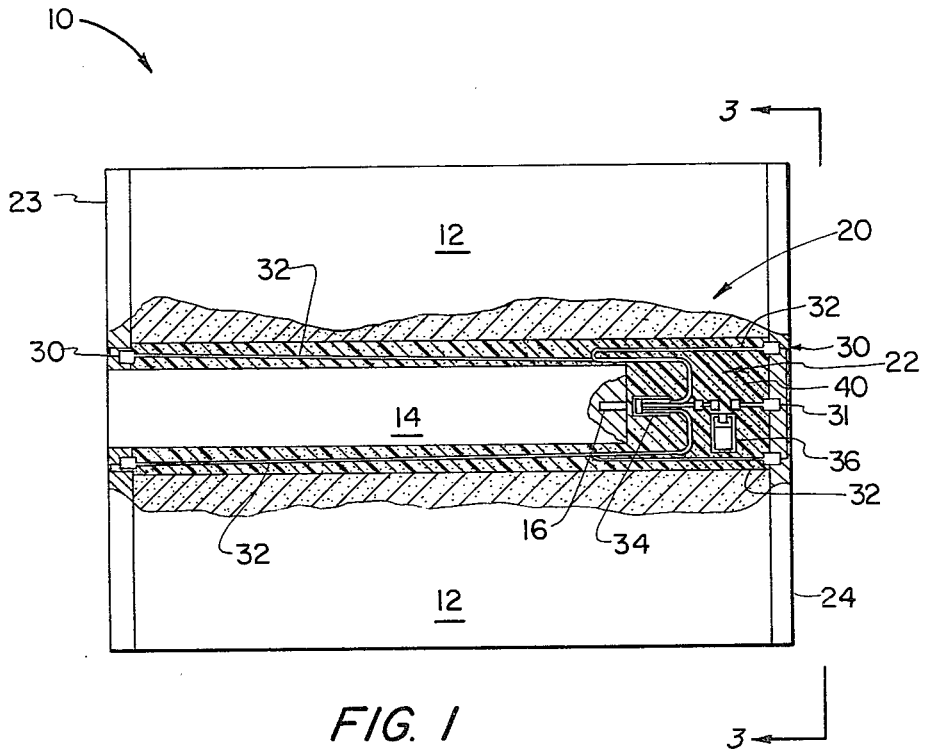
FIG. 1 is a cross section of a warhead incorporating the initiation system of the present invention.

Referring now to the drawings wherein like reference characters designate identical or corresponding parts throughout the several views, and more particularly to FIG. 1 thereof, a weapon warhead 10 is shown, partially in section, having the initiation system 20 of the present invention incorporated therein. The warhead 10, which for purposes of illustration may be installed within a missile, includes an explosive charge 12 and a safety and arming (S & A) assembly 14 positioned within a central bore in the charge, both items known in the art. The fragmentation casing normally enveloping the warhead has been omitted from the drawing.

Figure 3:
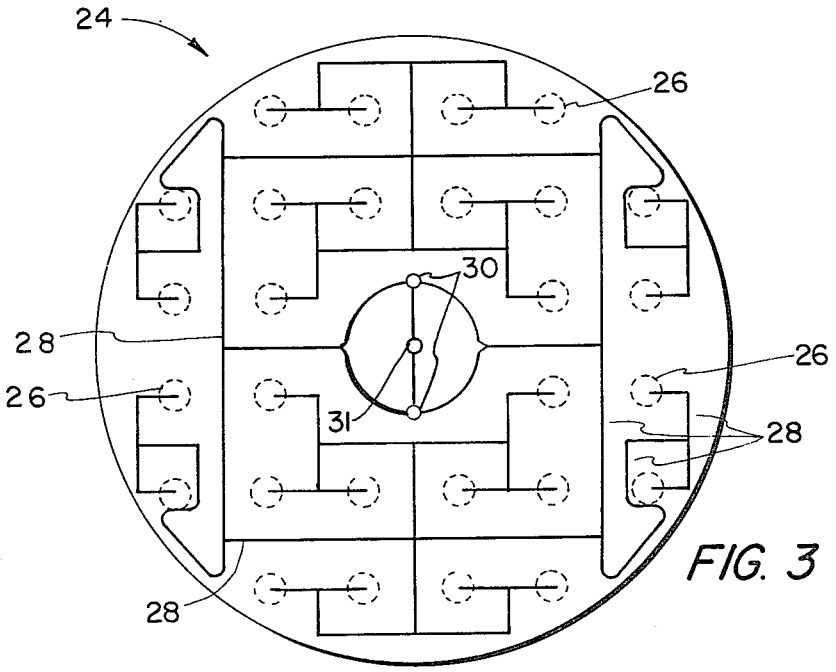
FIG. 3 is a view along line 3—3 of one of the end booster plates.
Figure 2:
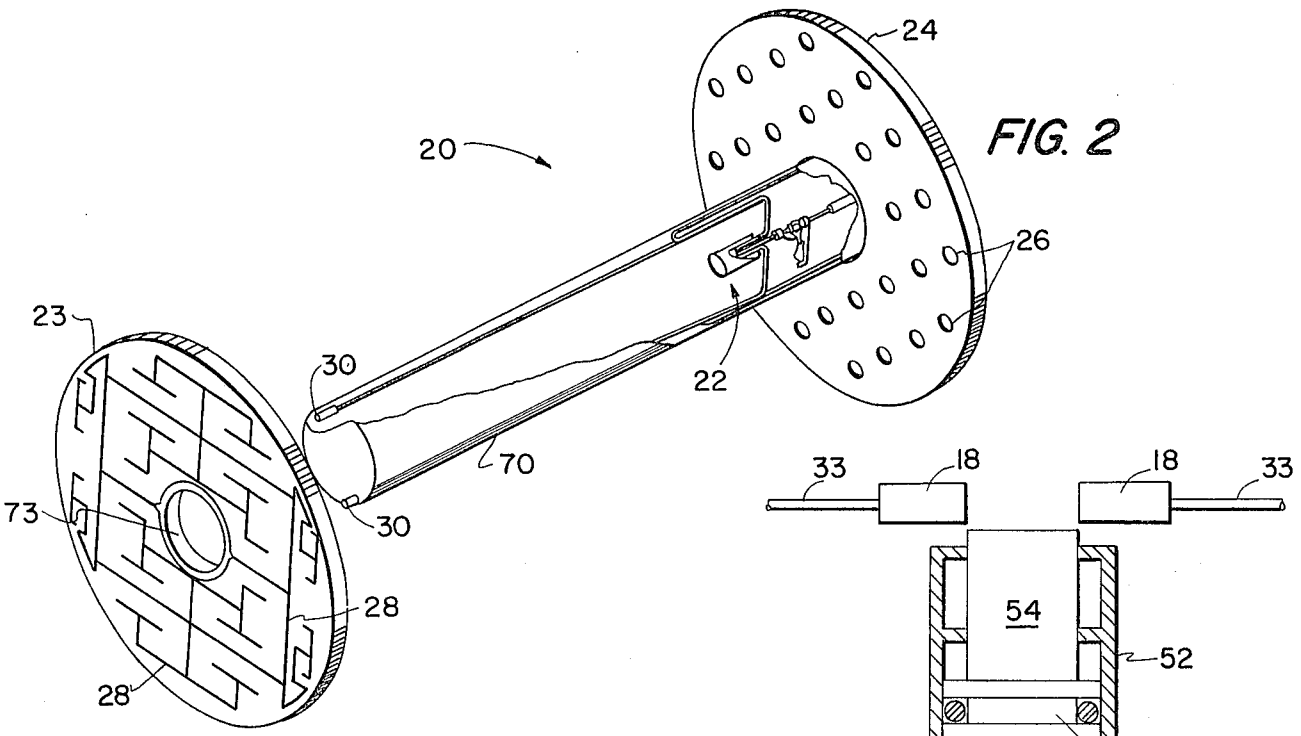
FIG. 2 is a perspective view of the initiation system.
Figure 7:
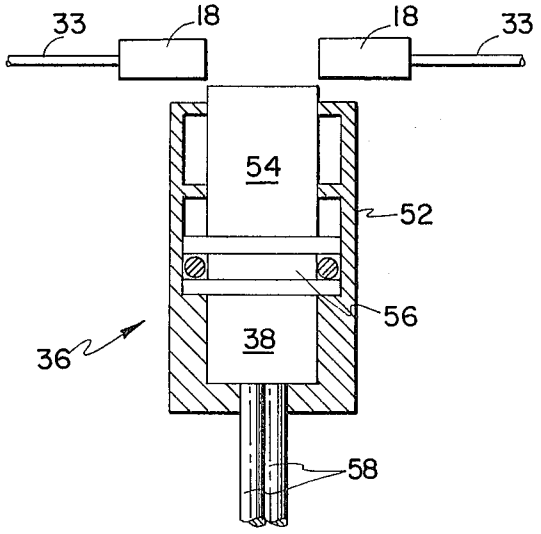
FIG. 7 is a detailed showing of the mode selector.

Major components of the warhead initiation system 20 include the initiation transfer assembly 22, a forward, end booster plate 23 and an aft, end booster plate 24. The booster plates provide simultaneous, multi-point, explosive output from the individual booster pellets 26 (FIGS. 2 and 3). This is achieved by providing the path length of the explosive transfer channels 28 of equal distance from the MDC end booster assemblies 30 to each of the pellets 26. Examples of the structure and operation of simultaneous, multipoint, explosive output devices are described in U.S. Pat. Nos. 3,896,731, 3,430,563, 3,311,055 and 3,016,831. The pellets 26 may be of PBXN 5, a pressed form of explosive having approximately 95% HMX explosive and 5% high thermal strength inert binder, such as Viton A. A suitable material for the transfer channels 28 is PBXN 301, an injection moldable explosive of 80% PETN and 20% silicone rubber binder. The initiation transfer assembly 22 comprises five, separate lines of explosive cord, such as common mild detonating cord 32, hereinafter referred to as MDC, which are swaged at one end into an acceptor manifold 34 (FIG. 5) or otherwise suitably grouped together and positioned adjacent the explosive output 16 of the S & A 14. With this arrangement, all five of the cords are simultaneously ignited by the S & A at the appropriate time. Four MDCs of equal length are provided at their other ends with explosive, booster assemblies 30, which in turn are received in recesses of the plates 23 and 24, respectively. The fifth MDC 33 is shorter than the other four and is terminated at an end booster 31 positioned in the center of the aft booster plate 24 via an initiation mode selector 36 (FIG. 7).

Figure 4:
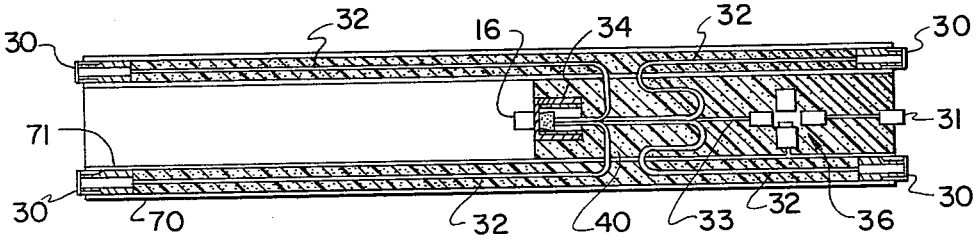
FIG. 4 is a cross section of the initiation transfer assembly.

In the drawings, the acceptor manifold 34 and the initiation mode selector 36 are positioned closer to one of the end booster plates, shown as plate 24, and the terms "fore" and "aft" are referenced with respect to this orientation. The shorter MDC 33 is terminated at the center of the plate closest to the mode selector 36. Since four of the MDCs 32 are of equal length and two of them are closer to the end plate 24, these two cords are bent into serpentine curves, as shown in FIG. 4. Each of the cords 32, extending from the manifold 34 to the end booster assemblies 30, is completely surrounded by shock attenuation material 40, which separates the looped portions of each cord from each other to prevent premature ignition of the warhead explosive 12, damage to the other MDCs, and crossover explosive paths. The end booster assemblies 30 and 31 secured to the ends of MDCs 32 and 33 are also securely held in place by the shock attenuation material to prevent displacements of the assemblies along the longitudinal axes of the cords and reduce lateral shock output and potential fragmentation damage of the warhead explosive.

Figure 5:
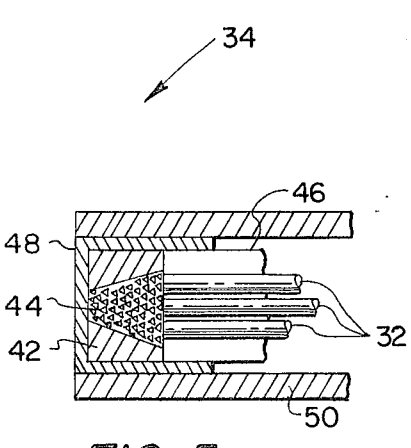
FIG. 5 is a cross section of one embodiment of the acceptor manifold.

Features of the acceptor manifold 34 may be seen in FIG. 5. A cylindrical, steel housing 42 has a frustum-shaped receptacle formed in its interior for receiving a powder charge 44. Each of the MDCs 32 and 33 (three visible in the plane shown) is in intimate contact with the powder at the major diameter of the receptacle and is held in position by means of the element 46. A metallic cap 48 is swaged against the holding element 46 at the open end of the cup to rigidly hold together the steel housing 42 and the element 46. Positioned over the housing 42 and the cap 48 is a cylindrical, steel sleeve 50 that has a substantial wall thickness and extends a sufficient length to effectively cover the interface between the explosive powder 44 and the cords 32. The sleeve 50 creates a gun barrel effect for directing the detonation gases and metal fragments from the explosion of power charge 44 along the longitudinal axis of the warhead and into the shock attenuation material 40 (see FIGS. 1 and 4). This provides protection for the warhead explosive 12 from possible damage by fragments from initiation of the manifold assembly 34 since radial particle distribution is limited and shock propagation in this direction is also restricted.

The acceptor manifold functions as the primary ignitor for the initiation transfer assembly 22 after activation of the S & A device 14 by the weapon's target detection device (TDD). Detonation by the S & A explosive output causes ignition of the powder charge 44, which is conically shaped to permit the detonation front to arrive at the face of each MDC 32 and 33 at the same instant to cause simultaneous detonation of each cord. Due to the frustum shape of the charge 44, it is initiated only by particles from the S & A explosive output which strike the center portion of the acceptor manifold, and other particles striking outside this central area will not effect initiation.

Figure 6:
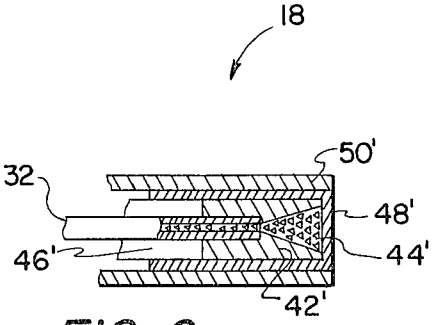
FIG. 6 shows a cross section of one embodiment of the end booster for the explosive cord.

Shown in FIG. 6 is an example of a suitable explosive cord terminator 18 for the MDCs, which as the end booster assembly 30 transfers the detonation front from the cord 32 to the booster plates 23 and 24 and bridges the control gap provided in the cord 33 within the mode selector 36, as will be described more fully hereinafter. Structurally, the terminator 18 is similar to the acceptor manifold 34 shown in FIG. 5, and includes a cylindrical housing 42' provided with a frustum-shaped recess to contain a powder charge 44', the minor diameter of the frustum being in contact with the powder within the cord 32 (or 33) and its base adjacent to a metal cap 48'. Element 46' maintains the cord 32 within the terminator to ensure good contact between the powder charges, and a metallic sleeve 50' is swaged over these components to complete the assembly.

An alternative to the separate cylindrical housing 42 (42' in FIG. 6) and the element 46 (46', FIG. 6) of FIG. 5 would be a single cylindrical element, with one end bored to provide the conical recess to receive the powder charge and the other end drilled with the requisite number of holes to receive the ends of the MDCs, which are then secured in the holes with epoxy or similar substance.

The initiation mode selector 36, shown in FIG. 7, is interposed between the intermediate terminators 18 of the MDC 33 and has an electrically-activated, explosive actuator 38 secured at one end of a housing 52. Slidably received within the housing and extending from an opening at the other end thereof is a barrier element 54. Interposed between the actuator 38 and the barrier element is a piston member 56 which transmits the force of the actuator to the barrier to place it between the end terminators 18 of the MDC 33. Conductors 58 transmit the control signal from the launcher to the actuator 38. When it is desired to initiatiate the warhead 10 from both ends, the explosive actuator 38 responds to the launcher control signal and extends the barrier 42 between the terminators 18 to prevent propagation of the detonation along cord 33. The actuator is completely self-contained, and during actuation, no fragments or gases escape from the assembly. Detonation along equal length cord 32, however, continue uninterrupted to simultaneously initiate the booster assemblies 30 in both the forward plate 23 and aft plate 24 and thereby achieve dual-ended initiation of the warhead 10.

The terminators 18 on the MDC 33 may be spaced about 0.3 inches, and a stroke of the barrier element of approximately 0.25 inches is sufficient. An alternative to the piston drive mechanism 44 illustrated in FIG. 7 would be a miniature bellows element, which is expanded by gases from the explosive device 38 to extend a barrier portion attached thereto between the terminators 18. Such mechanisms, also referred to as bellows motors, are commonly used and known in the art.

Figure 9:
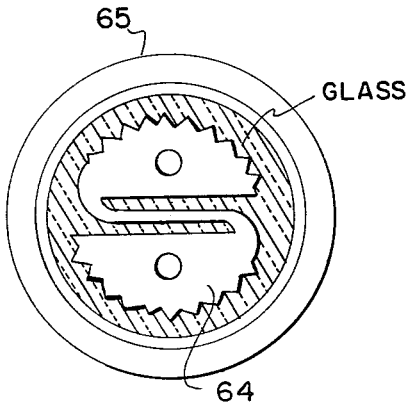
FIG. 9 is a view along line 9—9 of FIG. 8, showing the bridge element.
Figure 8:
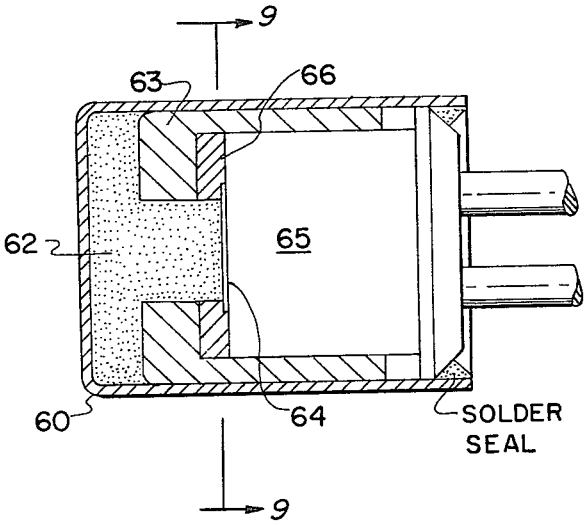
FIG. 8 shows details of the explosive actuator incorporated in the mode selector of FIG. 7.

An example of an explosive device suitable for use in the initiation mode selector 36 is shown in FIGS. 8 and 9, which illustrates the structure of a one ampere-one watt electro-explosive actuator suitable for military applications and is safety qualified against initiation by spurious signals. The actuator is designed to withstand the dissipation of one watt in and the passage of one amp through the initiating element for five minutes without ignition of the explosive elements. A cylindrical cup 60 has a propellant charge 62 of barium styphnate sandwiched between the closed end of the cup and a cup-shaped charge holder 62. A stem-like portion of the propellant charge 62 contacts the Evanohm bridge element 64 on the bottom of a glass/Kovar plug 65, the plug being positioned within the cup 60 and received within the open portion of the charge holder 63. An insulator disk 66 separates the charge holder and the base of the plug 65. The actuator 38 is hermetically sealed by soldering the cup 60 to the eyelet of the plug 65.

FIG. 9 shows the base of the plug 65 and shows the Evanohm bridge element 64 soldered to the lead wires 58. This bridge wire element, fabricated of etched foil, is designed to withstand an electrical current of one ampere or to dissipate one watt of electrical power for five minutes without igniting the propellant. The technique used to avoid static electricity hazards is to provide static discharge paths between the sharp points on the bridges saw-toothed perimeter and the charge holder 36. As shown in FIG. 8, the propellant does not physically contact the perimeter of the bridge element 64.

By way of example only, the initiation transfer assembly 22 can be conveniently packaged within a tube structure constructed of aluminum or like material, fabricated by an extrusion process in the form of a relatively thin-walled cylinder 70 that has portions of its wall formed into MDC housings extending along the longitudinal axis of the tube (see FIGS. 2 and 4). The tube can then be split longitudinally in half, and shock attenuation material, such as a mixture of equal parts of epoxy and hollow, glass microspheres having diameters in the range of 20–200 microns, molded into semicylinders to fit within the tube halves and provided with appropriate depressions to snugly receive the components of the initiation transfer system, can be inserted into the tube halves. Subsequently, the aforesaid components of the transfer system 22, including the MDCs, acceptor manifold, mode selector and cord end terminators, can be positioned in the premolded depressions, and the halves of the tube 70 secured together. A longitudinal recess 71 would be provided at one end of the tube to receive the S & A device 14.

The fully-assembled initiation system 20 and tube 70 is then positioned within the hollow core of the warhead explosive 12 (FIG. 1) and maintained in position by the two, end, booster plates 23 and 24. Each booster plate has a central cut out 73 (FIGS. 2 and 3) that conforms to the exterior wall shape of the tube 70, with each of the cord terminators 30 and 31 extending into recesses formed in each of the booster plates. This arrangement positions each terminator in correct alignment with the input to the booster end plate channel pattern 28 that is formed in sinuous paths to terminate at each booster charge pellet 26.

The channel patterns 28, machined or molded in each booster plate, are exactly the same length from input to the booster pellets and are filled with the explosive for forming a detonation path to initiate each booster charge pellet 26. Between the end of each terminator 30 and the connecting channel 28 is an air gap, which may be a few thousands of an inch in length, to prevent damage to the terminators during shock or vibration of the warhead. The air gap of each end is equalized by means of an elastic member which deforms slightly to maintain an equal air gap between each terminator and its respective booster plate.

Charge pads, not shown, are usually positioned between each end booster plate and each end cap of the warhead to protect the channel pattern 28 and form a compression means to keep each booster plate in intimate contact with the warhead explosive 12.

In operation and with the weapon directed against aerial targets, the warhead 10 is initiated by the single explosive output 16 of the S & A device 14 controlled by the TDD. Simultaneously therewith or shortly before, when the type of target has been determined, a control signal is transmitted to the mode selector 36 via the conductors 58 to activate the explosive device 38 and position the barrier element 54 between the intermediate terminators 18 of the MDC 33 in the manner described hereinabove.

Detonation of the acceptor manifold 34 by the S & A explosive output causes ignition of the powder charge 44 (FIG. 5), which due to its conical shape transmits the detonation front to the face of each MDC 32 and 33 at the same instant and thereby simultaneously initiates detonation of each cord. Each cord propagates a detonation along its length, and since all cords are of equal length the detonation front arrives at each cord terminator 30 substantially simultaneously. In the dual-ended initiation mode of the warhead, propagation of the detonation along the shorter MDC 33 ceases at the intermediate terminators 18 as a result of the barrier element 54 positioned therebetween. The use of two cords for each end booster plate increases reliability by providing a redundancy of function since either cord output will properly initiate its booster plate input. An additional factor is that the first cord to function at each end can initiate its booster plate independently, thereby reducing the end to end time differential which could occur due to time differences in propagation along each individual cord. As each detonating front travels through the housing formed in tube 70, particles and shock waves emanating from the cord 32 are attenuated by the shock absorbing material 40 and expansion of the shock absorbing material is permitted by opening of slots provided in the tube.

Each terminator 30 simultaneously projects fragments across the air gaps to detonate the input portion of the channel pattern 38, causing continuation of detonating fronts to the booster pellet charges 26. Each path length from the input to the booster pellet is the same length to cause simultaneous initiation of all the booster pellets. These charges detonate each of the end face of the main warhead explosive 12, causing detonating wave fronts to travel along the longitudinal axis of the explosive 12 and meet in a plane normal to the longitudinal axis and equidistant from either end. By directing the two opposite travelling detonating fronts to meet at the center of the explosive warhead causes a great force to extend radially outward to create a large, concentrated force that has more destructive effect than centrally detonated warheads and is thus more effective against aerial targets.

When the weapon is to be directed at surface targets, the mode selector actuator 38 is not activated and the barrier element 54 remains retracted. Ignition of the acceptor manifold 34 by the S & A and propagation of detonation along the MDCs 32 and 33 proceeds as described above. When the detonation front of cord 33 arrives at the first of the intermediate terminators, this front is propagated by the terminator across the small air gap therebetween. Since the cord 33 is much shorter than the cords 32, a detonation front arrives at cord terminator 31 positioned within the closer of the two end booster plates, or plate 24, and thereby initiate the input to this plate before the detonation front being propagated by the cords 32 has ignited the booster pellets 26 in the plate 23. Thus, by a combination of a higher detonation velocity of the warhead explosive and the much shorter propagation time through the shorter MDC 33, complete warhead detonation from the aft end will have occurred before the booster pellets in the forward plate have detonated. The result is a single-ended initiation of the warhead 10, which produces a wider spread in the fragmentation pattern that is more effective against surface targets.

Using a warhead explosive of PBXN 3, a pressed-type explosive composition of 86% HMX and 14% nylon filler, and explosive cords filled with a heat-resistant explosive such as DIPAM (dipicramid) as examples of suitable material, the detonation velocity through the warhead is about 20% faster than that of the MDC, on the order of 8300 meters/sec. This permits the detonation within the warhead to travel from the aft booster plate to the forward booster plate before the warhead explosive can be ignited by the forward booster plate 23, thus resulting in a single-ended initiation of the warhead.

A very critical advantage results from the present warhead initiation system. In the event that the initiation mode selector does not function properly, the warhead is not rendered inoperative but is still initiated since the present design allows for both initiation modes to be ignited. Thus, one mode or the other always exists depending upon the position of the barrier. Consequently the initiation system is inherently reliable.

Obviously numerous modifications and variations of the present invention are possible in the light of the above teachings. It is therefore to be undestood that within the scope of the appended claims the invention may be practiced otherwise than as specifically described herein.

What is claimed as new and desired to be secured by Letters Patent of the United States is:

1. A dual-mode initiation system for use in explosive warheads for selectively causing substantially simultaneous initiation at two ends or only at one end of the explosive warhead comprising:

an initiation transfer device positioned approximate one end of the explosive warhead and having primary and secondary ignitors;

a plurality of detonator trains interconnecting said primary and secondary ignitors, including at least two trains of equal length and a third train of shorter length;

booster explosive means positioned adjacent said secondary ignitor;

an initiation mode selector interposed between the ends of the shorter detonator train for controlling propagation of detonation along this train; and activation means positioned adjacent said primary ignitor for ignition of said primary ignitor, whereby the activation means ignites the primary ignitor, causing detonation fronts to simultaneously travel through said detonator trains, with the propagation of detonation front through the trains of equal length causing initiation of the explosive warhead at both ends by said booster explosive means and propagation of detonation front through the shorter train causing initiation of the warhead at one end prior to initiation at the other end.

2. The dual-mode initiation system of claim 1 wherein said initiation mode selector comprises:

a housing;

a movable barrier element within said housing; and an explosive actuator for controlling movement of said barrier element, whereby activation of said actuator positions said barrier element across the detonation front traveling along said shorter detonator train to prevent continued propagation of the detonation front along the shorter train.

3. The dual-mode initiation system of claim 2 wherein said shorter detonator train comprises two, intermediate sections of shorter length, the intermediate ends of said sections provided with secondary ignitors which are positioned adjacent to said movable barrier element.

4. The dual-mode initiation system of claim 3 wherein said secondary ignitors on the intermediate ends of said shorter detonator train are positioned to provide a predetermined spacing between said secondary ignitors.

5. The dual-mode initiation system of claim 3 wherein said primary ignitor comprises an explosive charge and one end of each of said plurality of detonator trains is in intimate contact with said explosive charge.

6. The dual-mode initiation system of claim 5 wherein said activation means comprises the explosive output signal from a safety and arming mechanism.

7. The dual-mode initiation system of claim 6 wherein said plurality of detonator trains includes four trains of equal length, two trains of equal length terminating in each end of the warhead.

8. In combination with an explosive warhead having an explosive charge and actuator means to control detonation of said charge, a dual-mode warhead initiation system for selectively causing substantially simultaneous initiation of both ends of said explosive charge or only at one end thereof which comprises:

an initiation transfer device positioned within and adjacent to one end of said explosive charge and having primary and secondary explosive ignitors;

a plurality of detonator trains interconnecting said primary and secondary ignitors, including at least two trains of equal length and a third train of shorter length, said third train terminating at the end of said explosive charge closest to said initiation transfer device;

booster explosive means positioned at the ends of said explosive charge and adjacent to said secondary ignitors; and an initiation mode selector interposed between the ends of said shorter detonator train for controlling propagation of detonation along this train, whereby the actuator means ignites the primary ignitor, causing detonation fronts to simultanously travel through said detonator trains, with the propagation of detonation front through the trains of equal length causing initiation of said explosive charge at both ends by said booster explosive means and propagation of detonation front through the shorter train causing initiation of the warhead at one end prior to initiation at the other end.

9. The combination of claim 8 wherein said initiation mode selector comprises:

a movable barrier element; and an electroexplosive actuator for controlling movement of said barrier element, whereby activation of said electroexplosive actuator positions said barrier element across the detonation front traveling along said shorter detonator train to prevent continued propagation of the detonation front along the shorter train.

10. The combination of claim 9 wherein said shorter detonator train comprises two, intermediate sections of shorter length, the intermediate ends of said sections provided with secondary ignitors which are positioned adjacent to said movable barrier element.

11. The combination of claim 10 wherein said primary ignitor comprises an explosive charge adjacent to said actuator means and one end of each of said plurality of detonator trains is in intimate contact with said explosive charge.

12. The combination of claim 11 wherein said plurality of detonator trains includes four trains of equal length, two trains of equal length terminating in each end of said warhead explosive charge.

13. The combination of claim 12 wherein said booster explosive means includes booster plates adjacent the ends of said warhead explosive charge, said plates having a plurality of explosive charges for simultaneously initiating detonation of said explosive charge at a plurality of different points.

* * * * *